US007846267B2

(12) United States Patent
Sherrel et al.

(10) Patent No.: US 7,846,267 B2
(45) **Date of Patent: *Dec. 7, 2010**

(54) CLEANING COMPOSITIONS AND METHODS OF USING SAME

(75) Inventors: Nancy Sherrel, Connelly Springs, NC (US); David Rogel, Homewood, IL (US)

(73) Assignee: United Laboratories, Inc., St. Charles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/559,197

(22) Filed: Sep. 14, 2009

(65) Prior Publication Data

US 2010/0004153 A1 Jan. 7, 2010

Related U.S. Application Data

(63) Continuation of application No. 11/744,215, filed on May 3, 2007, now Pat. No. 7,588,646.

(51) Int. Cl.

| | |
|---|---|
| ***B08B 3/04*** | (2006.01) |
| ***C11D 1/00*** | (2006.01) |
| ***C11D 3/43*** | (2006.01) |
| ***C11D 3/50*** | (2006.01) |
| ***C11D 3/382*** | (2006.01) |
| ***C11D 9/26*** | (2006.01) |

(52) U.S. Cl. ..... 134/39; 134/41; 134/42; 510/194; 510/195; 510/199; 510/245; 510/251; 510/342; 510/505

(58) Field of Classification Search ..... 510/194, 510/195, 199, 245, 251, 342, 505; 134/39, 134/41, 42

See application file for complete search history.

(56) References Cited

U.S. PATENT DOCUMENTS 5,340,495 A * 8/1994 Mulcahy et al. ..... 134/32
5,814,163 A * 9/1998 Wojcik ..... 134/39
5,815,163 A 9/1998 Dao et al.
6,586,366 B1 7/2003 Auda et al.
7,588,646 B2 * 9/2009 Sherrel et al. ..... 134/40

OTHER PUBLICATIONS

Definitions, 40 C.F.R. Sect. 51.100(s) (2007).
Determination of Volatile Organic Compounds (VOC) in Consumer Products and Reactive Organic Compounds in Aerosol Coating Products, California Environmental Protection Agency Air Resources Board, Adopted Sep. 25, 1997.
Environmental Protection Agency, "Analytical Methods: Method 1664, Revision A: N-Hexane Extractable Material (HEM: Oil and Grease) and Silica Gel Treated N-Hexane Extractable Material (SGT-HEM; Non-polar Material) by Extraction and Gravimetry," Oil and Grease & Revision A, pp. 1-25 (2007).
Environmental Protection Agency, Method 24: Determination of Volatile Matter Content, Water Content, Density, Volume Solids, and Weight Solids of Surface Coatings, 40 C.F.R. Pt. 60 App. A-7, pp. 467-501 (2007).
Environmental Protection Agency, Method 24A: Determination of Volatile Matter Content and Density of Publication Rotogravure Inks and Related Publication Rotogravure Coatings, 40 C.F.R. Pt. 60 App. A-7, pp. 501-548 (2007).
Standard Test Method for Kauri-Butanol Value of Hydrocarbon Solvents, American Society for Testing and Material, D1133-04.
Standards for Consumer Products, 40 C.F.R. Sect. 59.203(e) and (f) (2007).
Stephan, "STEPAN® C-25, C-40, C-48 and C-65 Methyl Esters," Product Bulletin, Argiculture, pp. 1-3.
Water Analysis Handbook, "Method No. 10056, Scope and Application: for Water and Wastewater," Oil and Grease, pp. 1-14 (2003).

* cited by examiner

*Primary Examiner*—Brian P Mruk
(74) *Attorney, Agent, or Firm*—Marshall, Gerstin & Borun LLP

(57) ABSTRACT

The invention is generally related to cleaning compositions and methods of using same. More particularly, the invention is related to cleaning compositions which are substantially free of volatile organic chemicals.

20 Claims, No Drawings

CLEANING COMPOSITIONS AND METHODS OF USING SAME

CROSS-REFERENCE TO RELATED APPLICATION

This is a continuation of U.S. Ser. No. 11/744,215, filed May 3, 2007, (now U.S. Pat. No. 7,588,646) the entire disclosure of which is incorporated herein by reference.

BACKGROUND OF THE INVENTION

1. Field of the Invention

The invention is generally related to cleaning compositions and methods of using same. More particularly, the invention is related to cleaning compositions which are substantially free of volatile organic chemicals.

2. Brief Description of Related Technology

Cleaning compositions are well known. Most cleaning compositions contain at least one chemical substance which has broad application as a solvent.

Solvents make up a very broad and important segment of the chemical industry. Solvents are commonly used both in final products such as cleaners, polishes, pesticides, dyes, coatings, inks, and the like, and for the manufacturing of various products and chemical substances.

Important properties of solvents include the ability to dissolve other materials (or solvency), their purity and/or consistent composition, evaporation characteristics (including vapor pressure and non-volatile residue), adverse effects on humans (toxicity), adverse effects on the environment (biodegradability, ozone depletion), combustibility (flash point), availability, and cost. Because of their potential to damage both humans and the environment, solvents are the subject of many regulations.

Solvents are as diverse chemically as their applications and uses. The general term "solvent" implies an organic chemical substance, i.e., a molecule comprising carbon, hydrogen, nitrogen, oxygen, phosphorus, and/or sulfur.

When only carbon and hydrogen are present in solvent molecules, the solvents are classified as hydrocarbon solvents. Hydrocarbon solvents are typically derived from petroleum. Common petroleum hydrocarbon solvents include mineral spirits, kerosene, petroleum distillates, naphtha, Stoddard solvent, and aromatics. The foregoing hydrocarbon solvents are mixtures and have variable compositions, which depend upon the petroleum source and various manufacturing parameters. Other solvents consisting essentially of a single chemical component may also be derived from petroleum. Representative examples include toluene, benzene, hexanes, pentane, and the like.

When chemical elements in addition to carbon and hydrogen are introduced into the solvent molecules, other solvents are formed. For example, halogenated hydrocarbon solvents contain carbon, hydrogen, and chlorine and/or fluorine. As a group, halogenated solvents have many desirable properties such as high solvency, high evaporation rates, and high flash points. However, most of these substances are either banned from general use or are restricted in their use as solvents because of their detrimental effects on the environment and relatively high human toxicity.

Oxygenated solvents contain oxygen, carbon, and hydrogen. Oxygenated solvents are further divided into chemical classes such as alcohols, ketones, esters, and ethers. Each of these classes has specific properties which leads to it being more specialized in their application as solvents. Certain of these compounds exhibit varying degrees of relatively high human toxicity, however.

Additionally, many of the foregoing solvents are (or include) volatile organic compounds (VOC's), which are organic chemical compounds that have sufficiently high vapor pressures under normal conditions to significantly vaporize and enter the atmosphere. 40 C.F.R. §51.100(s) defines VOC to include "any compound of carbon, excluding carbon monoxide, carbon dioxide, carbonic acid, metallic carbides or carbonates, and ammonium carbonate, which participates in atmospheric photochemical reactions." There are numerous exempted solvents, however. For example, various halogenated solvents are excluded. Additionally, 40 C.F.R. §59.203(e) provides that fragrances which are incorporated into a consumer product up to a combined level of two weight-percent are exempted from the VOC regulations. 40 C.F.R. §59.203(f) also exempts organic compounds having a vapor pressure of less than 0.1 millimeters of mercury at 20° C., organic compounds having more than 12 carbon atoms, if the vapor pressure is unknown, or organic compounds having a melting point higher than 20° C. which do not sublime (i.e., compounds which do not change directly from a solid into a gas without melting), if the vapor pressure is unknown.

In any event, VOC's participate in reactions that result in tropospheric ozone formation (and smog). Further, high concentrations of VOC's have been associated with various health problems. Because of their negative effects on the environment and human well being, such compounds are the subject of numerous regulations world wide. Of course, such regulations apply to paints, coating compositions, cleaning compositions, and other compositions comprising solvents.

Thus, there is a need for cleaning compositions which do not contain VOC's in appreciable quantities. Previous efforts to formulate cleaning compositions having relatively low VOC's have used solvents obtained from citrus fruits and soy beans. Although such products achieved low levels of VOC's relative to technologies existing at that time, further reductions in VOC levels are desired. It is a significant challenge, however, to reduce the level of VOC's in a cleaning composition while substantially retaining or even improving its cleansing power relative to prior art cleaning compositions containing higher levels of VOC's.

DETAILED DESCRIPTION

One aspect of the invention provides a cleaning composition which is substantially free of VOC's (as determined by U.S. Clean Air and Water Act regulations). Advantageously, the cleansing power of the compositions is substantially retained or even increased relative to prior art cleaning compositions containing significantly higher levels of VOC's. Furthermore, the cleaning compositions are less toxic, have low environmental impact, and present a low fire hazard (i.e., the compositions have a high flash point) at least relative to prior art cleaning compositions containing higher levels of VOC's. Moreover, the cleaning compositions may be substantially free of nonyl phenol ethoxylates.

The cleansing properties of the cleaning compositions are useful for cleaning and/or degreasing many substances, and thus another aspect of the invention provides for methods of using the cleaning compositions in numerous application methods. For example, the cleaning compositions can be applied to remove materials including but not limited to numerous polar, nonpolar, inorganic, organic, and particulate materials from substrate surfaces including but not limited to metal, glass, wood, and concrete surfaces. The compositions can therefore be applied to remove grease, oil, tar, bugs, paint, asphalt, and dirt from vehicles and other road equipment, floors, walls, and windows. Additionally, the compositions can be used to treat drains and lift stations.

In various aspects, the cleaning compositions have a Kauri-butanol ("Kb") value greater than about 70, greater than about 72, and/or greater than about 75. The Kauri-butanol value is a standardized measure of solvent power for a solvent, and is thus strongly correlated to the cleansing power of a cleaning composition. The Kb value is determined in accordance with ASTM Test Method D 1133. The invention advantageously provides cleaning compositions having increased Kb values at least relative to prior art cleaning compositions containing higher levels of VOC's.

The cleaning compositions generally comprise a solvent, and may optionally further include one or more of a fragrance, a primary surfactant, a co-surfactant, and a coupling agent. The various components of the compositions are typically substantially free of VOC's. However, the solvent, the fragrance, the primary surfactant, the co-surfactant, and/or the coupling agent may contribute some VOC's to the cleaning compositions provided that the final composition is substantially free of VOC's. In one aspect, "substantially free of VOC's" means that a cleaning composition contains less than about 10 wt. % of VOC's, based on the total weight of the composition. More preferably, the cleaning compositions contain less than about 2 wt. %, and most preferably less than about 0.25 wt. % of VOC's (e.g., the VOC content is attributable to impurities present in the final composition). VOC content can be measured in accordance with U.S. EPA Method 24/24A, the entire respective disclosure of which is hereby incorporated herein by reference. In another aspect, VOC content can be measured in accordance with California Environmental Protection Agency Air Resources Board Method 310, which references ASTM Test Method D 2369-97, the entire respective disclosures of which are hereby incorporated herein by reference.

In another embodiment, each of the components of the cleaning compositions have a vapor pressure of less than 0.1 millimeters of mercury at 20° C. In a further embodiment, each of the components of the cleaning compositions comprise organic compounds consisting of more than 12 carbon atoms.

In yet another embodiment, the cleaning composition can be packaged in an aerosol dispensing container with propellant such as carbon dioxide.

The cleaning composition generally comprise about 1 wt. % to about 100 wt. %, about 30 wt. % to about 95 wt. %, about 50 wt. % to about 90 wt. %, and/or about 75 wt. % to about 85 wt. % of the solvent. The cleaning compositions typically contain greater than about 50 wt. %, greater than about 60 wt. %, greater than about 70 wt. %, and/or greater than about 80 wt. % of the solvent. The solvent typically provides solvency to the cleaning compositions, i.e., the solvent provides the compositions with the ability to solvate various polar, nonpolar, inorganic, organic, and particulate materials, thereby facilitating their removal from a substrate surface.

The solvent generally comprises alkyl esters or mixtures of alkyl esters. Alkyl esters include but are not limited to methyl, ethyl, propyl, butyl, pentyl, and hexyl esters. The alkyl esters may be derived from $C_8$-$C_{18}$ fatty acids such as lauric, myristic, palmitic, oleic, stearic, linoleic, and linolenic acids. Esters derived from $C_{12}$-$C_{14}$ fatty acids are preferred because of their advantageous combination of degreasing ability and exemption from regulations concerning volatile organic compounds. Methyl esters derived from lauric acid are particularly preferred. Suitable methyl ester products are available under the CE-1270, CE-1295, CE-1495, and CE-1218 trade names (P&G Chemicals Americas, OH), and the STEPAN® C-25, C-40, C-48, and C-65 trade names (Stepan Company, IL).

The solvent may further comprise vegetable oils such as rapeseed oil, soybean oil, and canola oil. Further, the solvent may include one or more of glycerol, glycerol ethers, alcohol esters, glycerol esters, and glycol esters for example such as glycerol monooleate, glycol dicaprylic/capric ester, PEG ester, polyglycerol ester, propylene glycol/dicaprylate/dicaprate ester, and trimethylylol propane/tricaprylate/caprate ester.

The solvent generally includes greater than about 50 weight percent ("wt. %") alkyl esters. In one aspect, the solvent contains more than about 50 wt. % of alkyl laurate(s). In a refinement of this aspect, the solvent includes greater than about 50 wt. %, greater than about 80 wt. %, greater than about 90 wt. %, greater than about 95 wt. %, and/or greater than about 99 wt. % methyl laurate.

The cleaning composition may comprise about 1 wt. % to about 50 wt. %, about 1 wt. % to about 25 wt. %, and/or about 3 wt. % to about 10 wt. % of the fragrance. The fragrance imparts a pleasant aroma to the cleaning compositions, and serves to mask the odor of the other component(s) therein. Also, the fragrance can contribute additional solvency to the cleaning compositions, thereby facilitating the removal of various polar, nonpolar, inorganic, organic, and particulate materials from substrate surfaces. Furthermore, the fragrance can beneficially lower the freezing point of the cleaning compositions so they can be used at lower temperatures.

The fragrance may be selected from fragrances which are substantially free of VOC's and fragrances which contain VOC's provided that the weight percent of the fragrance components which comprise VOC's does not exceed the maximum allowable level required for a VOC exemption. Suitable fragrances include but are not limited to lilial, vanilin, 2,3,8,8-tetramethyl-1,2,3,4,5,6,7,8-octahydro-2-naphthalenyl methyl ketone, citronellol (e.g., beta-citronellol), geraniol, linalool, benzyl salicylate, hexyl cinnamic aldehyde, methyl cedrylone, galaxolide, tonalid, essential oils including but not limited to orange oil, lavender oil and eucalyptus oil, terpineol (e.g., alpha-terpineol), amyl cinnamic aldehyde, ethylene brassylate, ambrox, methyl salicylate, camphene, pinene (e.g., beta-pinene and alpha-pinene), beta-myrcene, limonene, camphor, estragole, alpha-cedrene, cineole, terpinen-4-ol, benzyl acetate, synthetic aroma chemicals such as aliphatic/aromatic esters, aliphatic/aromatic ketones and aliphatic/aromatic aldehydes, and combinations thereof. More preferably, the fragrance is selected from essential oils and synthetic aroma chemicals such as aliphatic/aromatic esters, aliphatic/aromatic ketones, and aliphatic/aromatic aldehydes. Suitable fragrances are available under the ISO-E-SUPER™ trade name (International Flavors & Fragrances, N.Y). Additionally, VOC-free fragrances are commercially available (e.g., Coast or Coast-type fragrances from Intercontinental Fragrances, TX, and Bell Flavors & Fragrances, Inc., NY).

The cleaning composition may comprise about 0 wt. % to about 75 wt. %, about 1 wt. % to about 25 wt. %, about 3 wt. % to about 10 wt. %, and/or about 7 wt. % of the primary surfactant. The primary surfactant allows the cleaning composition to be washed away with water. The primary surfactant also helps the cleaning composition wet different surfaces and thereby facilitates removal of polar, nonpolar, inorganic, organic, and particulate materials from substrate surfaces. Furthermore, the primary surfactant can beneficially lower the freezing point of the cleaning compositions so they can be used at lower temperatures. Additionally, the incorporation of a surfactant into the cleaning composition allows it to be diluted with water.

Any suitable surfactant, which is generally defined herein to include but not be limited to anionic surfactants, cationic surfactants, nonionic surfactants, amphoteric surfactants, and mixtures thereof may be used as the primary surfactant in the cleaning compositions. Suitable primary surfactants include but are not limited to nonionic surfactants or mixtures of nonionic surfactants such as amine oxides, fluorosurfactants, alkylglucosides, fatty amine ethoxylates, ether amines, alkylpolyglucosides, ethoxylated amines (e.g., ethoxylated amines having $C_5$-$C_{26}$ alkyl groups and 2 to 15 moles of ethylene oxide), alkanolamides (e.g., fatty acid alkanolamides and/or alkanolamides derived from vegetable oil), betaines (including derivatives thereof), alcohol ethoxylates (e.g., narrow range alcohol ethoxylates, linear alcohol ethoxylates having alcohol chain lengths between $C_5$-$C_{26}$ and 1 to 40 moles of ethoxylation, fatty alcohol ethoxylates, guerbet alcohol ethoxylates, end-capped fatty alcohol ethoxylates, oleyl-cetyl alcohol ethoxylates, and branched secondary alcohol ethoxylates), ethoxylated alkyl aryl moieties, ethoxylated fatty acids, alkoxylated fatty alcohols, ethylene oxide/propylene oxide copolymers, octylphenol ethoxylates, nonylphenol ethoxylates, fatty alcohols, end-capped fatty alcohol alkoxylates, sultaine (including derivatives thereof), fatty alkyl ethoxylates, alkylphenol ethoxylates, alkanamides, and mixtures thereof. A preferred primary surfactant comprises a blend of 9 carbon, 10 carbon, 11 carbon, 12 carbon, and 13 carbon chain length alcohols having an average of 6 moles of ethylene oxide. Suitable primary surfactants are available under BIOSOFT™ trade name (Stepan Company, IL) and the TOMADOL™ and TOMADYNE™ trade names (Tomah Products, Inc., LA).

The cleaning composition may comprise about 0 wt. % to about 50 wt. %, about 1 wt. % to about 25 wt. %, about 1 wt. % to about 10 wt. %, and/or about 3 wt. % of the co-surfactant. The co-surfactant provides some metal corrosion inhibition properties to the cleaning compositions. Additionally, similar to the primary surfactant, the co-surfactant allows the cleaning compositions to be washed away with water, and helps the cleaning composition wet different surfaces. Furthermore, the co-surfactant can beneficially lower the freezing point of the cleaning compositions so they can be used at lower temperatures.

The co-surfactant may include nonionic surfactants or mixtures of nonionic surfactants such as amine oxides, fluorosurfactants, alkylglucosides, fatty amine ethoxylates, ether amines, alkylpolyglucosides, ethoxylated amines (e.g., ethoxylated amines having $C_5$-$C_{26}$ alkyl groups and 2 to 15 moles of ethylene oxide), alkanolamides (e.g., fatty acid alkanolamides and/or alkanolamides derived from vegetable oil), betaines (including derivatives thereof), alcohol ethoxylates (e.g., narrow range alcohol ethoxylates, linear alcohol ethoxylates having alcohol chain lengths between $C_5$-$C_{26}$ and 1 to 40 moles of ethoxylation, fatty alcohol ethoxylates, guerbet alcohol ethoxylates, end-capped fatty alcohol ethoxylates, oleyl-cetyl alcohol ethoxylates, and branched secondary alcohol ethoxylates), ethoxylated alkyl aryl moieties, ethoxylated fatty acids, alkoxylated fatty alcohols, ethylene oxide/propylene oxide copolymers, octylphenol ethoxylates, nonylphenol ethoxylates, fatty alcohols, end-capped fatty alcohol alkoxylates, sultaine (including derivatives thereof), fatty alkyl ethoxylates, alkylphenol ethoxylates, alkanamides, and mixtures thereof. A preferred co-surfactant is a mixture of bis-(2-hydroxyethyl) isodecyloxypropylamine and bis-(2-hydroxyethyl) isotridecyloxypropylamine. Suitable co-surfactants are available under the BIOSOFT™ trade name (Stepan Company, IL) and the TOMADOL™ and TOMADYNE™ trade names (Tomah Products, Inc., LA).

The cleaning composition may comprise about 0 wt. % to about 25 wt. %, about 1 wt. % to about 15 wt. %, about 1 wt. % to about 10 wt. %, and/or about 3 wt. % of the coupling agent. The coupling agent helps homogenize the various other component(s) of the cleaning compositions and thus prevents separation. The coupling agent can also facilitate wetting of different surfaces to help remove polar, nonpolar, inorganic, organic, and particulate materials from those surfaces. Additionally, the coupling agent can depress the freezing point of the cleaning compositions so they can be used at lower temperatures.

Suitable coupling agents include glycols including but not limited topropylene glycol, dipropylene glycol, tripropylene glycol, and hexylene glycol, glycol ethers including but not limited to glycol ether DPnB, various alcohols, isopropyl myristate, isopropyl palmitate, PEG-6 lauramide, amines including but not limited to triethanolamine, ester solvents including but not limited to methyl acetate, ketones including but not limited to acetone, and mixtures thereof. A preferred coupling agent comprises glycols including but not limited to propylene glycol, dipropylene glycol, tripropylene glycol, hexylene glycol, and mixtures thereof. Dipropylene glycol is a particularly preferred. Suitable coupling agents are widely available from many chemical manufacturers.

The cleaning compositions can be applied to remove grease, oil, tar, bugs, paint, asphalt, and dirt residues from vehicles and other road equipment, floors, walls, and windows. Additionally, the cleaning compositions can be used as part of a regular maintenance program to keep drains sanitary and running freely. In such a method, a quantity of a cleaning composition is added to a drain and allowed to stand for a period of time (e.g., from about two minutes to about 15 minutes). The drain should then be flushed with hot water (e.g., for about one to about five minutes). If the drain remains clogged, the treatment can be repeated. Similarly, the compositions can be used to treat lift stations. In such a method, an amount of a cleaning composition is added to the lift station such that about 2 cm to about 6 cm of material floats on the surface of the water.

Cleaning compositions in accordance with the invention can be better understood in light of the following examples.

Example 1

FOG Solvency Comparison

The previously mentioned increased Kb values are particularly advantageous for using the cleaning compositions in grease traps. Fats, oils, and greases ("FOG") collect in the drain pipes and grease traps of restaurants and industrial facilities. The purpose of a grease trap is to capture the FOG from residual water before entering the sewer main. A cleaning composition in accordance with the invention can be added to the grease-water mixture in the grease trap. The cleaning composition causes the solidified fats, oils, and greases to liquefy, and float to the top of the water. The liquefied cleaning composition/FOG mixture can then be removed from the grease trap before the water enters the sewer main. If the level of FOG in the water is too high (usually above 100 ppm), the facility could be severely fined. Hence, it is imperative to find a solvent that will liquefy the solidified FOG in the grease trap and allow the solvent/FOG mixture to float to the top of the grease trap such that the water that flows to the sewer main is not contaminated with FOG.

An experiment was conducted to simulate the conditions in a grease trap. 200 grams of FOG was added to four 1000 mL beakers. 300 mL of tap water was then added to the beakers. An additional 300 mL of tap water was added to the first beaker. 300 mL of a cleaning composition in accordance with the invention (comprising greater than about 70 wt. % methyl laurate) was added to the second beaker. 300 ml of a technical grade of d-limonene (Florida Chemical Company, Inc., FL) was added to the third beaker. 300 mL of a soy methyl ester based cleaning product (SOYGOLD®, Ag. Environmental Products, NE) was added to the fourth beaker. The beakers were allow to sit for a given period of time. Then, the water was separated from the beakers and the FOG levels (of the various water samples) were determined.

The Hach Test Method 10056 and US EPA Test Method 1664 were used to determine the FOG levels. The tests measure the HEM (Hexane Extractable Material) and SGT HEM (Silica Gel Treated Hexane Extractable Material). HEM includes any material that is soluble in the n-hexane extractant (such as oil, grease, total petroleum hydrocarbons, non-volatile hydrocarbons, vegetable oils, animal fats, waxes, soaps, greases, and related materials).

To determine HEM, the various water samples are extracted with n-hexane and then the n-hexane is evaporated. The residue left is weighed to determine the concentration of the above listed materials in mg/L.

SGT-HEM includes any material that is soluble in the n-hexane extractant but which does not bind to the silica gel mixed into the n-hexane extractant. SGT-HEM substances might include a "Total Petroleum Hydrocarbon" such as an aliphatic petroleum hydrocarbon (e.g., octane, nonane, etc.) To determine SGT-HEM, the residue isolated from the HEM test is redissolved in hexane, the hexane is mixed with silica gel to absorb the non Total Petroleum Hydrocarbon materials, the silica gel is then filtered from the n-hexane using a filter paper, and the hexane is then evaporated. The residue left is weighed to determine the concentration of SGT-HEM (by subtracting the weight of the residue from SGT-HEM test from the weight of the residue from the HEM test).

D-limonene released 6.6 times more FOG into the water than the cleaning composition in accordance with the invention. Additionally, the soy methyl ester cleaning composition released 1.6 times more FOG into the water than the cleaning composition in accordance with the invention.

The foregoing results are very favorable because it is desirable for the cleaning composition to release as little FOG into the water as possible. Additionally, the cleaning composition in accordance with the invention is VOC free whereas d-limonene and soy methyl ester contain VOC's.

Example 2

Comparison Performance Testing

A steel sheet was coated with thick used oil from a diesel engine. The steel plate is put at a vertical angle. One pipette containing a cleaning composition in accordance with the invention is dispensed at the top of the plate. Similarly, pipettes containing d-limonene and soy methyl ester were dispensed at different areas at the top of the plate. The plate was then allowed to sit for a given amount of time and observed at 2 minutes and 15 minutes. At 2 minutes, the cleaning composition in accordance with the invention cleaned away as much oil as d-limonene (as subjectively measured by the amount of metal revealed on the plate) whereas the soy methyl ester solvent barely cleaned away any oil. At 15 minutes, the cleaning composition in accordance with the invention cleaned away considerably more oil than both d-limonene and soy methyl ester-based cleaning products (which were the same as the ones described in Example 1).

These results are significant because the composition in accordance with the invention demonstrated cleaning power equal to d-limonene, which is combustible (relatively low flash point) and which contains 100% VOC. Furthermore, the composition in accordance with the invention demonstrated cleaning power far exceeding the degreasing ability of d-limonene at 15 minutes. At both 2 and 15 minutes, the cleaning composition in accordance with the invention far exceeds the degreasing power of the soy methyl ester solvent.

The cleaning compositions are not limited to the embodiments described above, but rather are capable of variation and modification without departure from the scope of the appended claims.

What is claimed is:

1. A method of cleaning a surface of a substrate, the method comprising:

applying a cleaning composition comprising a coupling agent selected from the group consisting of glycols, glycol ethers, alcohols, amines, esters, and ketones, and a solvent including at least one alkyl ester to a substrate surface having an undesirable residue thereupon, and, removing the residue, wherein the cleaning composition contains greater than about 80 weight percent ("wt. %") of the alkyl ester and the cleaning composition contains less than about 2 wt. % volatile organic compounds ("VOC's").

2. The method according to claim 1, wherein the alkyl ester is derived from a $C_8$-$C_{18}$ fatty acid.

3. The method according to claim 1, wherein the cleaning composition comprises greater than about 50 wt. % of an ester derived from lauric acid.

4. The method according to claim 3, wherein the cleaning composition comprises greater than about 50 wt. % of methyl laurate.

5. The method according to claim 4, wherein the cleaning composition comprises greater than about 70 wt. % of methyl laurate.

6. The method according to claim 1, wherein the residue is selected from the group consisting of polar, nonpolar, inorganic, organic, and particulate materials.

7. The method according to claim 1, wherein the substrate surface is selected from the group consisting of metal, glass, wood, and concrete surfaces.

8. The method according to claim 1, wherein the cleaning composition further comprises at least one fragrance.

9. The method according to claim 1, wherein the cleaning composition further comprises a first surfactant.

10. The method according to claim 9, wherein the cleaning composition further comprises a second surfactant.

11. The method according to claim 1, wherein the cleaning composition comprises greater than about 80 wt. % of methyl laurate.

12. The method according to claim 1, wherein the cleaning composition contains about 1 wt. % to about 15 wt. % of the coupling agent.

13. The method according to claim 1, wherein the cleaning composition contains about 1 wt. % to about 10 wt. % of the coupling agent.

14. The method according to claim 1, wherein the cleaning composition contains about 3 wt. % of the coupling agent.

15. The method according to claim 1, wherein the coupling agent is selected from the group consisting of propylene glycol, dipropylene glycol, tripropylene glycol, hexylene propylene glycol, dipropylene glycol normal butyl ether (glyco) ether DPnB), isopropyl myristate, isopropyl palmitate, PEG-6 lauramide, triethanolamine, methylacetate, acetone, and mixtures thereof.

16. The method according to claim 1, wherein the coupling agent is selected from the group consisting of propylene glycol, dipropylene glycol, tripropylene glycol, hexylene propylene glycol, and mixtures thereof.

17. A cleaning composition comprising a coupling agent selected from the group consisting of glycols, glycol ethers, alcohols, amines, esters, and ketones, and a solvent including at least one alkyl ester, wherein the cleaning composition contains greater than about 80 weight percent ("wt. %") of the alkyl ester and the cleaning composition contains less than about 2 wt. % volatile organic compounds ("VOC's").

18. The cleaning composition according to claim 17, the composition containing about 1 wt. % to about 10 wt. % of the coupling agent.

19. The cleaning composition according to claim 17, wherein the coupling agent is selected from the group consisting of propylene glycol, dipropylene glycol, tripropylene glycol, hexylene propylene glycol, and mixtures thereof.

20. The cleaning composition according to claim 17, wherein the cleaning composition comprises greater than about 70 wt. % of methyl laurate.

* * * * *